United States Patent [19]

Miyazaki

[11] 4,249,363

[45] Feb. 10, 1981

[54] INCORRECT COIN NUMBER DETECTOR FOR COIN WRAPPING MACHINE

[75] Inventor: Yorizo Miyazaki, Tokyo, Japan

[73] Assignee: Laurel Bank Machine Co., Ltd., Japan

[21] Appl. No.: 76,145

[22] Filed: Sep. 17, 1979

[30] Foreign Application Priority Data

Sep. 18, 1978 [JP] Japan ..... 53-127788[U]

[51] Int. Cl.[3] ..... B65B 57/18

[52] U.S. Cl. ..... 53/508; 53/504; 53/212

[58] Field of Search ..... 53/504, 507, 508, 77, 53/53, 54, 212

[56] References Cited

U.S. PATENT DOCUMENTS 4,058,954 11/1977 Asami ..... 53/504 X

*Primary Examiner*—Travis S. McGehee

*Attorney, Agent, or Firm*—Fleit & Jacobson

[57] ABSTRACT

Herein disclosed is an incorrect coin number detector to be used with a coin wrapping machine for detecting whether or not a preset number of piled coins are correctly wrapped when the both ends of wrapping paper are fastened by means of a pair of fastening claws. The incorrect coin number detector includes stroke setting means for setting the stroke of the one of the fastening claws and accordingly the shortest spacing inbetween. Further inclusive is actuating means for moving the one fastening claw toward the other with the aid of a coil spring. Still further inclusive is incorrectness detecting means having a detecting switch for generating, when actuated by the fastening claw moving mechanism through an actuating lever, the signals which are indicative of the incorrectness in the number of the piled coins being wrapped. Positioning means is also included for determining the relative position of the actuating lever to the fastening claw moving mechanism in accordance with the correct length of the piled coins.

3 Claims, 1 Drawing Figure

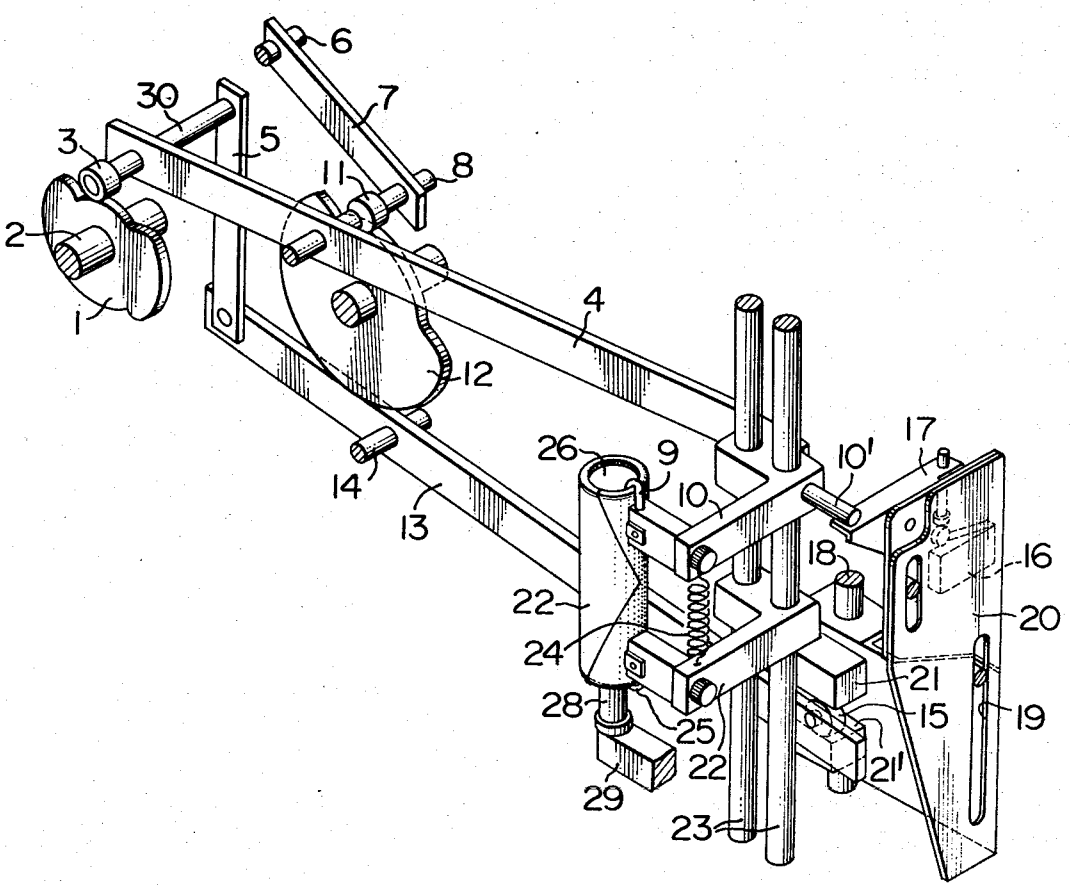
1
2
3
4
5
6
7
8
9
10
10'
11
12
13
14
15
16
17
18
19
20
21
21'
22
22
23
24
25
26
28
29
30

INCORRECT COIN NUMBER DETECTOR FOR COIN WRAPPING MACHINE

BACKGROUND OF THE INVENTION

1. Field of the Invention

The present invention relates to a coin wrapping machine, and more particularly to an incorrect coin number detector to be used with the coin wrapping machine for detecting whether or not a preset number of piled coins are correctly wrapped when the both ends of wrapping paper are fastened by means of a pair of fastening claws.

2. Description of the Prior Art

In a coin wrapping machine according to the prior art, coins to be wrapped are arranged into a row on a rotary disc and conveyed to a coin passage, where they are counted. Then, the coins are made to drop into a piling cylinder so that a preset number of piled coins may be prepared. The coins thus piled in the piling cylinder are then carried at their bottom and taken out of the piling cylinder by means of a carrying rod until they are brought to a wrapping roller assembly. In this roller assembly, the piled coins are turned in contact by a plurality of rotating wrapping rollers. In this meanwhile, wrapping paper is wound on the coin pile and cut a preset length. Then, a pair of fastening claws come to fasten the both ends of the wound paper, thus finishing the wrapping operations.

SUMMARY OF THE INVENTION

It is therefore a major object of the present invention to provide an incorrect coin number detector to be used with a coin wrapping machine for detecting the shortage and excessiveness in the number of piled coins being fastened for their wrapping purposes.

According to a major feature of the present invention, there is provided an incorrect coin number detector for use with a coin wrapping machine, comprising: fastening means for fastening the both ends of the wrapping paper, in which a preset number piled coins are wrapped, said fastening means including a movable shaft, a fastening lever made rotatable about said movable shaft, an upper fastening arm connected to one end of said fastening lever and having an upper fastening claw, a shaft providing a pivotal point for said fastening lever, and a lower fastening arm made coactive with said upper fastening arm and having a lower fastening claw for fastening the both end of the wrapping paper together with said upper fastening claw: stroke setting means including a cam follower mounted on the pivotal point providing shaft, and a coin kind setting cam having its cam surface contacting with said cam follower for setting the stroke of said upper fastening arm and accordingly the shortest spacing between the upper and lower fastening claws; actuating means including a cam follower mounted on said movable shaft, a fastening cam having its cam surface contacting with said cam follower for turning said fastening lever and accordingly said upper fastening arm toward said lower fastening arm, and biasing means for biasing the upper and lower fastening arms toward each other; incorrectness detecting means including a support arranged in the vicinity of said upper fastening arm, a detecting switch mounted on said support for generating, when actuated, signals indicative of the incorrectness in the number of the piled coins being wrapped, and an actuating lever mounted on said support for actuating said detecting switch when it is pushed by said upper fastening arm; and positioning means for determining the relative positions of said actuating lever to said upper fastening arm in accordance with the correct length of the piled coins, said positioning means including a position change lever having its one end connected to said support, and a connecting lever connected pivotally to said pivotal point providing shaft and connected to the other end of said position change lever.

BRIEF DESCRIPTION OF THE DRAWING

Other objects and advantages of the present invention will become apparent from the following description taken in connection with the accompanying drawing showing in a perspective view an incorrect coin number detector exemplifying the present invention

DESCRIPTION OF THE PREFERRED EMBODIMENT

The present invention will now be described in more detail in connection with the embodiment thereof with reference to the accompanying drawing.

Indicated at reference numberal 1 is a coin kind setting cam which is turned in accordance with the kind of coins to be wrapped by means of a shaft 2 which is made coactive with the coin kind dial, not shown, of a coin wrapping machine. A fastening lever 4 and a connecting lever 5 are made coactive with the coin kind setting cam 1 through a cam follower 3. The fastening lever 4 is pivotally supported on a movable shaft 8 which is mounted in an arm lever 7 which in turn is pivotally supported on a center shaft 6. The fastening lever 4 thus supported is connected to an upper fastening arm 10 which carries an upper fastening claw 9. On the other hand, the aforementioned movable shaft 8 is in contact with a fastening cam 12 through a cam follower 11.

The aforementioned connecting lever 5 is connected to a position change lever 13 which is pivotally supported on a pivot shaft 14. The position change lever 13 has its remaining end connected to a support 20 which in turn is guided by a rod 18 and a guide slot 19 while supporting a detecting switch 16 and an actuating lever 17. More specifically, the position change lever 13 has its follower 15 interposed between blocks 21 and 21' which are mounted on the support 20.

Both the aforementioned upper fastening arm 10 and a lower fastening arm 22 carrying a lower fastening claw 25 are actuated, while being guided together by rods 23, to a fastening extent by means of a coil spring 24 and a conventional mechanism, not shown.

Incidentally, reference numerals 26, 27 and 28 indicate a preset number of piled coins, wrapping paper, and a carrying rod, respectively. Moreover, numeral 29 indicates a lift arm which is operative to move the carrying rod 28 from a piling cylinder into a plurality of wrapping rollers, neither of which are shown, so that the piled coins 26 may be carried always a preset stroke.

When, in operation, a preset number of the piled coins 26 are carried from the piling cylinder to the shown position by the carrying rod 28 of the lift arm 29 and are wrapped in the wrapping paper 27 by the actions of the wrapping rollers, the both end portions of the wrapping paper 27 are fastened by the upper and lower fastening claws 9 and 25 of the upper and lower fastening arms 10 and 22 through the urging force of the spring 24 in response to the clockwise rotation, as shown, of the fastening lever 4 contacting with the fastening cam 12. Since, in this instance, both of the fastening arms 10 and 22 are made rotatable from their fastening positions about one of the rods 23, they are made coactive with the fastening lever 4 in the vertical direction but not in the horizontal direction, the detail of which is omitted here.

When the coin kind dial of the coin wrapping machine is adjusted to the kind of the coins to be wrapped, the shaft 2 is turned in response thereto, and the fastening lever 4 is turned about the movable shaft 8 through the cam follower 3 contacting with the shaft 2 so that the vertical position of the upper fastening arm 10 is adjusted. Namely, this upper fastening arm 10 can take the position corresponding to the height of the pile of the coins to be wrapped. Incidentally, the lower fastening arm 22 need not have its position adjusted, because the lowermost position of the lift arm 29 is kept the same for all kinds of coins, but is retained at a preset position by means of a retaining mechanism, not shown. The connecting lever 5 made coactive with the cam follower 3 also responds to the rotation of the aforementioned upper fastening lever 4 to turn the position change lever 13 about the pivot shaft 14 so that the vertical position of the support 20 is adjusted along the rod 18 and the guide slot 19 through the follower 15 and the blocks 21 and 21'. As a result, the detecting switch 16 and the actuating lever 17 are adjusted to their positions corresponding to the height of the piled coins 26.

After the adjustments thus far described, the fastening cam 12 starts its rotation so that the fastening lever 4 is turned about the shaft 30 of the cam follower 3 to move the upper fastening arm 10 downward thereby to fasten the upper end of the wrapping paper 27. Simultaneously with this, since the lower fastening arm 22 is released from its retained condition, the lower end of the wrapping paper 27 is also fastened by the biasing force of the spring 24. These fastening operations are continued until the tip of the upper fastening claw 9 is brought into contact to the upper end face of the coin pile 26. In case a correct number of coins are piled, one end of the upper fastening arm 10, e.g., a pin 10' is stopped at a position close to the actuating lever 17, thus leaving this lever 17 inoperative. On the contrary, if the number of the piled coins is short, the downward movement of the upper fastening arm 10 is so increased that the pin 10' is brought into contact with the actuating lever 17 to actuate the detecting switch 16. This switch 16 generates, when actuated, signals informing the operator of the shortage of the piled coins. Incidentally, although the foregoing description is directed to the cases in which the number of the piled coins is correct and short, it should be understood that the present invention can also be applied to the detection of excessive coins merely by changing the design of the positional relationship between the actuating lever 17 and the detecting switch 16 while leaving the construction of other parts unchanged.

As has been described hereinbefore, according to the present invention, the detection of the number of the piled coins can be accomplished with the use of the simple mechanism thus far described at the wrapping step, in which the detection is found the most difficult, so that any trouble after the wrapping operations can be precluded.

What is claimed is:

1. An incorrect coin number detector for use with a coin wrapping machine, comprising: fastening means for fastening the both ends of the wrapping paper, in which a preset number of piled coins are wrapped, said fastening means including a movable shaft, a fastening lever made rotatable about said movable shaft, an upper fastening arm connected to one end of said fastening lever and having an upper fastening claw, a shaft providing a pivotal point for said fastening lever, and a lower fastening arm made coactive with said upper fastening arm and having a lower fastening claw for fastening the both end of the wrapping paper together with said upper fastening claw; stroke setting means including a cam follower mounted on the pivotal point providing shaft, and a coin kind setting cam having its cam surface contacting with said cam follower for setting the stroke of said upper fastening arm and accordingly the shortest spacing between the upper and lower fastening claws; actuating means including a cam follower mounted on said movable shaft, a fastening cam having its cam surface contacting with said cam follower for turning said fastening lever and accordingly said upper fastening arm toward said lower fastening arm, and biasing means for biasing the upper and lower fastening arms toward each other; incorrectness detecting means including a support arranged in the vicinity of said upper fastening arm, a detecting switch mounted on said support for generating, when actuated, signals indicative of the incorrectness in the number of the piled coins being wrapped, and an actuating lever mounted on said support for actuating said detecting switch when it is pushed by said upper fastening arm; and positioning means for determining the relative position of said actuating lever to said upper fastening arm in accordance with the correct length of the piled coins, said positioning means including a position change lever having its one end connected to said support, and a connecting lever connected pivotally to said pivotal point providing shaft and connected to the other end of said position change lever.

2. An incorrect coin number detector according to claim 1, further comprising guide means for guiding said support when the latter is moved by said position change lever, said guide means including a rod and a guide slot.

3. An incorrect coin number detector according to claim 1, wherein said biasing means includes a coil spring mounted between the upper and lower fastening arms.

* * * * *